US005296443A

United States Patent [19]

Suto

[11] Patent Number: 5,296,443

[45] Date of Patent: Mar. 22, 1994

[54] THERMAL TRANSFER IMAGE RECEIVING SHEET

[75] Inventor: Kenichiro Suto, Tokyo, Japan

[73] Assignee: Dai Nippon Printing Co., Ltd., Japan

[21] Appl. No.: 842,013

[22] Filed: Feb. 26, 1992

[30] Foreign Application Priority Data

Mar. 1, 1991 [JP] Japan ..... 3-57704

[51] Int. Cl.[5] ..... B41M 5/035; B41M 5/38

[52] U.S. Cl. ..... 503/227; 428/195; 428/212; 428/913; 428/914

[58] Field of Search ..... 8/471; 428/195, 212, 428/913, 914, 341, 342; 503/227

[56] References Cited

U.S. PATENT DOCUMENTS 4,778,782 10/1988 Ito et al. ..... 503/227

*Primary Examiner*—B. Hamilton Hess

*Attorney, Agent, or Firm*—Ladas & Parry

[57] ABSTRACT

A thermal transfer image receiving sheet comprising a substrate sheet, a dye receptor layer disposed on at least one surface side of the substrate sheet, and an antistatic agent layer disposed on the surface of the dye receptor layer; wherein the dye receptor layer comprises a solvent soluble antistatic agent.

When the above thermal transfer image receiving sheet is used, a sufficient antistatic property can be maintained so as to prevent the occurrence of the attachment of foreign substance such as dust even a full-color image is intended to be formed and the same region of the dye receiving layer is subjected to the dye transfer operation. As a result, there may be provided a full-color image of high quality free of a color dropout, etc.

14 Claims, 1 Drawing Sheet

THERMAL TRANSFER IMAGE RECEIVING SHEET

BACKGROUND OF THE INVENTION

The present invention relates to a thermal image receiving sheet, more particularly to a thermal transfer image receiving sheet which is capable of providing a full color image having a high quality without a color dropout, etc.

Heretofore, various thermal transfer methods have been known. Among these, there has been proposed a method wherein a sublimable dye (or subliming dye) is used as a recording agent, and is carried on a substrate sheet such as paper and plastic film to obtain a thermal transfer sheet, and various full color images are formed on an image receiving sheet such as paper and plastic film having thereon a dye receptor layer, by using the resultant thermal transfer sheet.

In such a case, a thermal head of a printer is used as heating means so that a large number of color dots of three or four colors are transferred to the image receiving sheet under heating in a very short period of time. As a result, a full color image of an original is reproduced by using the multi-color color dots.

The thus formed images are very clear and are excellent in transparency, since the dyes are used therein as a colorant. Accordingly, these images are excellent in half tone reproducibility and gradation characteristic, and are substantially the same as the images formed by the conventional offset printing and gravure printing. Further, when the above image forming method is used, there can be formed images of high quality which are comparable to full color photographic images.

In order to effectively carry out the thermal transfer method as described above, not only the structure of the thermal transfer sheet but also the structure of the image receiving sheet on which an image is to be formed is important. More specifically, at the time of the formation of the image, both of the thermal transfer sheet and the image receiving sheet are conveyed in a printer to be used for such image formation, and both of these sheets are rubbed with each other. As a result, the image receiving sheet may generally be charged and foreign substance such as dust is attached to the dye receiving surface of the image receiving sheet on the basis of the above charging, whereby a problem such as color dropout is posed. In general, it is necessary to solve such a problem by subjecting the thermal transfer sheet and/or the image receiving sheet to an antistatic treatment. For example, Japanese Laid-Open Patent Application (JP-A, KOKAI) No. 56489/1988 discloses a thermal transfer image receiving sheet wherein the surface of a dye receiving layer provided on one side surface of a substrate sheet is subjected to an antistatic treatment. However, in a case where a full-color image is intended to be formed by use of a thermal transfer system, since the same region of the dye receiving layer is subjected to the dye transfer operation three to four times, a sufficient antistatic property cannot be maintained when an antistatic agent is simply applied onto the dye receiving surface of the thermal transfer image receiving sheet. As a result, the above problem is not sufficiently solved and therefore a full-color image of high quality free of the color dropout has not been formed yet. Such a problem is posed not only in the case of a thermal transfer image receiving sheet to be used in combination with a thermal transfer sheet of a sublimable dye type, but also in the case of a thermal transfer image receiving sheet to be used in combination with a thermal transfer sheet of a melt transfer type.

SUMMARY OF THE INVENTION

Accordingly, a principal object of the present invention is, in view of the above problems posed in the prior art, to provide a thermal transfer image receiving sheet which is capable of providing a full-color image without a color dropout, etc.

According to the present invention, there is provided a thermal transfer image receiving sheet comprising a substrate sheet, a dye receptor layer disposed on at least one surface side of the substrate sheet, and an antistatic agent layer disposed on the surface of the dye receptor layer; wherein the dye receptor layer comprises a solvent-soluble antistatic agent.

When the above thermal transfer image receiving sheet according to the present invention is used, a sufficient antistatic property can be maintained so as to prevent the occurrence of the attachment of foreign substance such as dust even a full-color image is intended to be formed and the same region of the dye receiving layer is subjected to the dye transfer operation. As a result, there may be provided a full-color image of high quality free of a color dropout, etc.

DESCRIPTION OF THE PREFERRED EMBODIMENTS

Hereinbelow, the present invention will be described in more detail with reference to preferred embodiments thereof.

Figure 1:
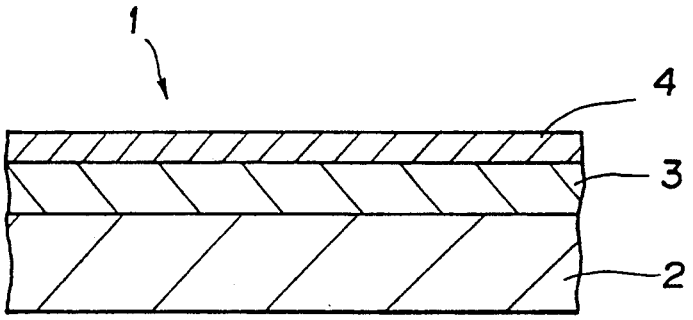
FIG. 1 is a schematic sectional view showing an embodiment of the thermal transfer image receiving sheet according to the present invention.

FIG. 1 is a schematic sectional view showing an embodiment of the thermal transfer image receiving sheet according to the present invention.

Referring to FIG. 1, the thermal transfer image receiving sheet 1 according to the present invention comprises a substrate sheet 2, a dye receptor layer 3 disposed on one surface side of the substrate sheet 2, and an antistatic agent layer 4 disposed on the dye receptor layer 3. In addition, in the present invention, the dye receptor layer 3 also comprises a solvent-soluble type antistatic agent (i.e., an antistatic agent which is soluble in a solvent).

Specific example of the substrate sheet 2 to be used in the present invention may include various paper such as synthetic paper (polyolefin type, polystyrene type, etc.), paper of fine quality or wood-free paper, art paper or coated paper, cast coated paper, wall paper, backing paper, synthetic resin impregnated paper or emulsion impregnated paper, synthetic rubber latex impregnated paper, synthetic resin containing paper, paper board, cellulose fiber paper, and the like; and various sheets or films of plastics such as polyolefin, polyvinyl chloride, polyethylene terephthalate, polystyrene, polymethacrylate, polycarbonate, and the like. Further, the substrate sheet 2 may also comprise a white opaque film formed from a mixture of the above synthetic resin and white pigment or filler, or a foamed sheet which has been subjected to foaming operation. However, the substrate sheet usable in the present invention should not be restricted to the above specific examples.

In addition, a laminate comprising an optional combination of the above substrate films may also be used as the substrate sheet 2. Representative examples of such a laminate may include: a combination of cellulose fiber paper and synthetic paper and a combination of cellulose fiber paper and plastic film or sheet.

The above substrate sheet may have an appropriate thickness, and for example, it may generally have a thickness of about 10 to 300 μm.

When the above substrate sheet shows a poor adhesion with respect to the dye receptor layer to be formed thereon, it is preferred to subject the surface of the substrate sheet to primer treatment or corona discharge treatment.

The dye receptor layer 3 to be formed on the surface of the above substrate sheet is one such that it may receive a sublimable dye migrating from (or transferring from) the thermal transfer sheet and may retain the thus formed image.

Specific examples of the resin for forming the dye receptor layer 3 may include: polyolefin type resin such as polypropylene; halogenated polymer such as polyvinyl chloride, and polyvinylidene chloride; vinyl type polymers such as polyvinyl acetate and polyacrylic acid esters; polyester type resin such as polyethylene terephthalate and polybutylene terephthalte; polystyrene type resins; polyamide type resins; copolymer resins comprising olefin such as ethylene and propylene, and another vinyl monomer; ionomers, cellulose type resins such as cellulose diacetate; polycarbonate; etc. Particularly preferred examples thereof may include vinyl type resins and polyester type resins.

In the present invention, the antistatic agent to be added to (or contained in) the dye receptor layer 3 is soluble in an organic solvent which is to be used at the time of the formation of the dye receptor layer. Any of antistatic agents known in the art can be used for such a purpose, as long as it has a solubility in an organic solvent. Specific examples of such an antistatic agent may include: cationic type antistatic agents such as quaternary ammonium salts, and polyamine derivatives; anionic type antistatic agents such as alkyl phosphates; and nonionic type antistatic agents such a fatty acid esters. More specifically, preferred examples thereof may include: Efucol 70 (mfd. by Matsumoto Yushi Seiyaku K. K.), TB-34 (mfd. by Matsumoto Yushi Seiyaku K. K.), Statiside (mfd. by Takihara Sangyo K. K.), Cation AB (mfd. by Nihon Yushi K. K.), Sofnon R2F10 (mfd. by Toho Kagaku Kogyo K. K.), Quinstat k-3 (mfd. by Kotani Kagaku Kogyo K. K.), Prisurf A208B, M208B, A-210G, A-212C, and A-212E (mfd. by Daiichi Kogyo Seiyaku K. K.), Chemistat 2500 and 3500 (mfd. by Sanyo Kasei Kogyo K. K.), Suftomer ST-2100 (mfd. by Mitsubishi Yuka K. K.), etc. Among these, the cationic type antistatic agent is preferred. In addition, among the cationic type antistatic agents, the quaternary ammonium salt type antistatic agents such as Efucol 70, TB-34, Statiside, Quinstat k-3 may particularly preferably be used, since such an antistatic agent not only imparts a good antistatic effect to the dye receptor layer 3 but also does not provide stickiness or tackiness to the surface of the dye receptor layer, whereby contamination such as fingerprint is less liable to adhere to the surface. Incidentally, it is not preferred to use a phosphate ester type surfactant (or surface active agent) as the antistatic agent since it is liable to cause the wear or rust of the thermal head to be used in combination therewith.

When the antistatic agent to be contained in the dye receptor layer 3 is not soluble in an organic solvent, the antistatic agent be separated from another component constituting the dye receptor layer 3 so that it can migrate to the surface of the dye receptor layer or can float on the surface thereof. As a result, the maintenance of the antistatic property becomes insufficient.

It is preferred to use the above antistatic agent in an amount of 0.1 to 1.0 wt. parts with respect to 100 wt. parts of a resin for forming the dye receptor layer. If the amount of the antistatic agent is too small, the antistatic effect based thereon is insufficient. On the other hand, if the amount thereof is too large, the dye receiving property and the storability of the resultant image of the dye receptor layer may undesirably be deteriorated. In addition, the distribution of the antistatic agent in the thickness direction of the dye receptor layer 3 may preferably be such that 50 wt. % or more of the antistatic agent is contained in a region corresponding to 1/5 of the thickness of the dye receptor layer 3 on the surface side thereof (i.e., on the side thereof on which the antistatic agent layer 4 is to be formed. When the antistatic agent is distributed in such a manner, a good antistatic property may stably be exhibited even when the same region of the dye receptor layer is subjected to the dye transfer operation plural times. Incidentally, in order to provide such a structure, it is preferred that the drying condition (i.e., the condition under which the dye receptor layer is dried) at the time of the formation of the dye receptor layer as described hereinbelow is selected so as to make the drying period of time as longer as possible, whereby the antistatic agent having a smaller molecular weight than that of the regin constituting the dye receptor layer may densely be distributed on the surface side of the dye receptor layer.

When the above dye receptor layer 3 is formed, a pigment or filler such as titanium oxide, zinc oxide, kaolin clay, calcium carbonate and silica fine powder can be added to the receptor layer for the purpose of improving the whiteness of the dye receptor layer to further improve the clarity (or color definition) of the resultant transferred image.

The dye receptor layer 3 may be formed by applying a solution or dispersion to one side surface of the above substrate sheet and then drying the resultant coating. The dispersion may be prepared by adding an additive such as antistatic agent, to the resin as described above, as desired, and dissolving the resultant mixture in an appropriate organic solvent, or dispersing the mixture in an organic solvent or water. The resultant solution or dispersion may be applied onto the substrate sheet, e.g., by a gravure printing method, a screen printing method, a reverse roll coating method using a gravure plate, etc.

The dye receptor layer to be formed in the above manner can have an arbitrary thickness, but may generally have a thickness of 1 to 50 μm. Such a dye receptor layer may preferably comprise a continuous coating but may also be formed as a discontinuous coating by using a resin emulsion or resin dispersion.

Basically, the thermal transfer image receiving sheet according to the present invention having the above structure is usable in practice, but the dye receptor 3 to be used in the present invention may also contain a release agent such as organic silicone compound for the purpose of imparting thereto a good releasability with respect to the thermal transfer sheet to be used in combination therewith.

In the present invention, it is required that an antistatic agent layer 4 is further formed on the surface of the above dye receptor layer 3. When the antistatic agent layer 4 is not formed, the antistatic effect is not sufficient at an initial stage of the thermal transfer operation, and further it is difficult to retain the antistatic effect in the subsequent step of the operation. The antistatic agent used in the antistatic agent layer 4 is not particularly restricted but may be any of those known in the Art. However, as described above, a quaternary ammonium salt type antistatic agent is particularly preferred.

The antistatic layer 4 may be formed by using an organic solvent solution or an aqueous solution of the antistatic agent and by using any of various coating methods such as spraying method. The coating amount of the antistatic agent may generally be about 0.01 to 1.0 $g/m^2$ based on its solid content. It is preferred that the coating amount of the antistatic agent is about 1 to 10 times that of the antistatic agent contained in the dye receptor layer 3.

Incidentally, the antistatic agent contained in the dye receptor layer 3 and the antistatic agent used in the antistatic agent layer 4 to be disposed on the dye receptor layer comprise antistatic agents of the same type. For example, when a cationic type antistatic agent and an anionic type antistatic agent are used in combination both of the antistatic agents may be reacted with each other so as not to provide a sufficient antistatic effect in some cases.

In the thermal transfer image receiving sheet according to the present invention, it is also possible to dispose a cushion layer, as desired, between the substrate sheet and the dye receptor layer. When the cushion layer is disposed therebetween, noise produced at the time of printing can be suppressed and an image corresponding to image information can reproducibly be formed by the transfer recording operation. It is also possible to incorporate an antistatic agent in the above cushion layer.

Figure 2:
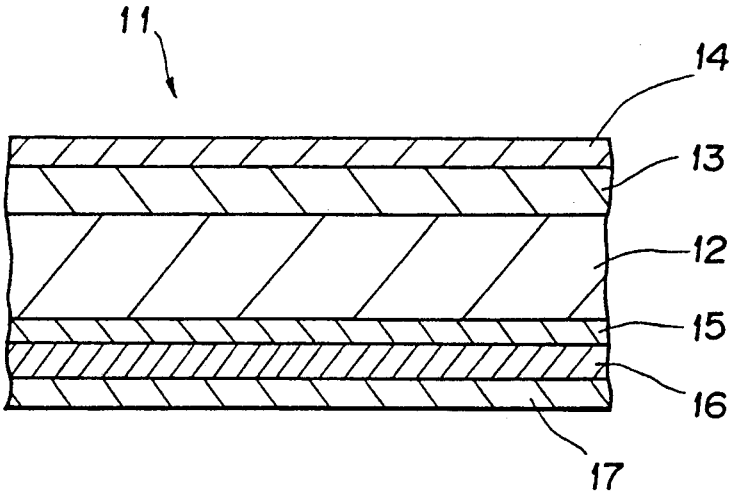
FIG. 2 is a schematic sectional view showing another embodiment of the thermal transfer image receiving sheet according to the present invention.

FIG. 2 is a schematic sectional view showing another embodiment of the thermal transfer image receiving sheet according to the present invention.

Referring to FIG. 2, the thermal transfer image receiving sheet 11 according to the present invention comprises a substrate sheet 12, a dye receptor layer 13 containing an antistatic agent disposed on one surface side of the substrate sheet 12, and an antistatic agent layer 14 disposed on the dye receptor layer 13, in the same manner as in the thermal transfer image receiving sheet 1 as described above. In addition, the thermal transfer image receiving sheet 11 also comprises, a slip layer 16 and an antistatic agent 17 on the other surface side of the substrate sheet 11 by the medium of a primer layer 15. The slip layer 16 may comprise a material such as methacrylate resin (inclusive of methyl methacrylate), corresponding acrylate resin, and vinyl type resins such as vinyl chloride-vinyl acetate copolymer. The primer layer 15 and slip layer 16 may also contain an antistatic agent.

In addition, it is possible to form an antistatic agent layer on a back surface of the image receiving sheet shown in FIG. 1, or to form a laminate of a dye receptor layer and an antistatic layer, on the back surface of the image receiving sheet shown in FIG. 1, in the same manner as in the case of the front surface thereof.

In the present invention, it is possible to dispose a detection mark (or a mark to be detected) in the thermal transfer image receiving sheet. The detection mark is very useful, e.g., in a case where the thermal transfer sheet is subjected to positioning operation with respect to the image receiving sheet. For example, it is possible to dispose a detection mark which is detectable by means of a phototube detection device, on the back surface of the substrate film by printing, etc.

The thermal transfer image receiving sheet according to the present invention is applicable to various uses such as transfer receiving sheet or card on which thermal transfer recording can be effected, and sheet for forming transmission type original to be used for such a purpose.

When a thermal transfer operation is carried out by use of the thermal transfer image receiving sheet according to the present invention as described above, it is possible to use a thermal transfer sheet comprising a substrate such as paper and polyester film and a dye layer disposed thereon comprising a sublimable dye, in combination with the above image receiving sheet. Any of thermal transfer sheets known in the art as such can be used in the present invention.

The means for applying heat energy to be used at the time of the thermal transfer operation may be any of various known heat energy application means. For example, when a recording time is controlled by using a recording apparatus such as a thermal printer (e.g., Video Printer VY 100, mfd. by Hitachi Seisakusho K.K.), so as to provide a heat energy of about 5 to 100 $mJ/mm^2$, a desired object may sufficiently be attained.

Hereinbelow, the present invention will be described in more detail with reference to Experiment Examples. In the description appearing hereinafter, part(s) and % are part(s) by weight and wt. %, respectively, unless otherwise noted specifically.

Sample 1

A transparent polyethylene terephthalate sheet having a thickness of 75 μm (trade name: T-60, mfd. by Toray K.K.) was used as a substrate sheet.

A coating liquid for a receptor layer having the following composition was applied onto one surface side of such a substrate film by means of a bar coater so as to provide a coating amount of 5.0 $g/m^2$ (after drying), and after 30 sec. elapsed from the application, the resultant coating was preliminarily dried by means of a dryer, and then dried in an oven for 5 min. at 120° C., whereby a dye receptor layer was formed.

| Coating liquid for receptor layer | |
|---|---|
| Polyester resin (trade name: Bairon 600, mfd. by Toyobo K.K.) | 4.0 parts |
| Vinyl chloride-vinyl acetate copolymer (trade name: #1000A, mfd. by Denki Kagaku Kogyo K.K.) | 6.0 parts |
| Amino modified silicone (trade name: X-22-3050C, mfd. by Shinetsu Kagaku Kogyo K.K.) | 0.2 part |
| Epoxy modified silicone (trade name: X-22-3000E, mfd. by Shinetsu Kagaku Kogyo K.K.) | 0.2 part |
| Chemistat 2500 (mfd. by Sanyo Kasei Kogyo K.K.) | 0.1 part |
| Methyl ethyl ketone/toluene (wt. ratio = 1:1) | 89.5 parts |

Then, a coating liquid for a primer layer having the following composition was applied onto the back surface of the above film by means of a bar coater so as to provide a coating amount of 0.5 g/m$^2$ (after drying) and further a coating liquid for a back surface slip layer was applied onto the surface of the resultant primer layer so as to provide a coating amount of 1 g/m$^2$ (based on solid content) and the resultant coating was dried in the same manner as described above. Thereafter, a solution of an antistatic agent was applied onto the surface of the receptor layer and the back surface so as to provide a coating amount of 0.5 g/m$^2$ (based on solid content) by means of a spray and then dried, whereby a thermal transfer image receiving sheet (Sample 1) according to the present invention was prepared.

| | |
|---|---|
| Coating liquid for primer layer | |
| Polyester polyol (trade name: Adcoat mfd. by Toyo Morton K.K.) | 15.0 parts |
| Methyl ethyl ketone/toluene (wt. ratio = 2:1) | 85.0 parts |
| Coating liquid for back surface slip layer | |
| Acrylic resin (trade name: BR-85, mfd. by Mitsubishi Rayon K.K.) | 15.0 parts |
| Filler (trade name: Orgasol, mfd. by Nihon Rirusan K.K.) | 0.1 part |
| Cationic type antistatic agent (TB-128, mfd. by Matsumoto Yushi Seiyaku K.K.) | 0.1 part |
| Methyl ethyl ketone/toluene (wt. ratio = 2:1) | 89.8 parts |
| Antistatic agent solution | |
| Cationic type antistatic agent (trade name: Statiside AR-30, mfd. by Takihara Sangyo K.K.) | 1.0 part |
| Isopropyl alcohol | 10.0 parts |

Sample 2

A thermal transfer image receiving sheet (Sample 2) according to the present invention was prepared in the same manner as in the preparation of Sample 1 except that the following antistatic agents were respectively used instead of the antistatic agents used in Sample 1.

Receptor layer . . . trade name: TOF-1100TM, mfd. by Nihon Yushi K.K.

Slip layer . . . trade name: New Paracriner, mfd. by Kyowa Gas Kagaku K.K.

Spray . . . trade name: SAT-5, mfd. by Nihon Junyaku

Sample 3

A thermal transfer image receiving sheet (Sample 3) according to the present invention was prepared in the same manner as in the preparation of Sample 1 except that the following antistatic agents were respectively used instead of the antistatic agents used in Sample 1.

Receptor layer . . . trade name: New Paracriner, mfd. by Kyowa Gas Kagaku K.K.

Slip layer . . . trade name: New Paracriner, mfd. by Kyowa Gas Kagaku K.K.

Spray . . . trade name: New Paracriner, mfd. by Kyowa Gas Kagaku K.K.

Sample 4

A thermal transfer image receiving sheet (Sample 4) according to the present invention was prepared in the same manner as in the preparation of Sample 1 except that the following antistatic agents were respectively used instead of the antistatic agents used in Sample 1, and the coating amounts of the coating liquids for the slip layer and the antistatic agent solution were 0.1 g/m$^2$ (based on solid content).

Receptor layer . . . Cationic antistatic agent (trade name: Efucol 70, mfd. by Matsumoto Yushi Seiyaku K.K.)

Slip layer . . . Cationic antistatic agent (trade name: TB-128, mfd. by Matsumoto Yushi Seiyaku K.K.)

Spray . . . Cationic antistatic agent (trade name: Statiside, mfd. by Takihara Sangyo K.K.)

Sample 5

A thermal transfer image receiving sheet (Sample 5) according to the present invention was prepared in the same manner as in the preparation of Sample 1 except that the following antistatic agents were respectively used instead of the antistatic agents used in Sample 1, and the coating amounts of the coating liquids for the slip layer and the antistatic agent solution were 0.1 g/m$^2$ (based on solid content).

Receptor layer . . . Cationic antistatic agent (trade name: Cation AB, mfd. by Nihon Yushi K.K.)

Slip layer . . . Cationic antistatic agent (trade name: TB-34, mfd. by Matsumoto Yushi Seiyaku K.K.)

Spray . . . Cationic antistatic agent (trade name: Quinstat k-3, mfd. by Kotani Kagaku Kogyo K.K.)

Sample 6

A thermal transfer image receiving sheet (Sample 6) according to the present invention was prepared in the same manner as in the preparation of Sample 1 except that the following antistatic agents were respectively used instead of the antistatic agents used in Sample 1, and the coating amounts of the coating liquids for the slip layer and the antistatic agent solution were 0.1 g/m$^2$ (based on solid content).

Receptor layer . . . Cationic antistatic agent (trade name: Efucol 70, mfd. by Matsumoto Yushi Seiyaku K.K.)

Slip layer . . . Cationic antistatic agent (trade name: Efucol 70, mfd. by Matsumoto Yushi Seiyaku K.K.)

Spray . . . Cationic antistatic agent (trade name: Efucol 70mfd. by Matsumoto Yushi Seiyaku K.K.)

Samples 7 to 9

A thermal transfer image receiving sheets (Samples 7 to 9) according to the present invention were prepared in the same manner as in the preparation of Sample 1 except that the following substrate sheets were respectively used instead of the substrate sheet used in Sample 1.

Sample 7: White polyethylene terephthalate film (trade name: W400, mfd. by Diafoil K.K., thickness=100 μm)

Sample 8: Synthetic paper (trade name: Yupo FPG-150, mfd. by Oji Yuka K.K., thickness=150 μm)

Sample 9: Art paper (trade name: Kinfuji, mfd. by Kanzaki Seishi K.K., basis weight=157 g/m$^2$)

Sample 10

A thermal transfer image receiving sheet (Sample 10) according to the present invention was prepared in the same manner as in the preparation of Sample 1 except that a phosphate ester type surface active agent (trade name: Prisurf A-208, mfd. by Daiichi Kogyo Seisaku K.K.) was used instead of the modified silicone used in the coating liquid for the receptor layer used in the preparation of Sample 1.

Sample 11

A thermal transfer image receiving sheet (Sample 11) according to the present invention was prepared in the same manner as in the preparation of Sample 1 except that an anionic type antistatic agent (trade name: Dusper 802D, mfd. by Miyoshi Yushi K. K.) was used instead of the antistatic agent used in the coating liquid for the receptor layer used in the preparation of Sample 1, and an anionic type antistatic agent (trade name: Homogetorn L-18 mfd. by Kao K. K.) was used instead of the antistatic agent used in the antistatic agent solution used in the preparation of Sample 1.

Sample 12

A thermal transfer image receiving sheet (Sample 12) according to the present invention was prepared in the same manner as in the preparation of Sample 1 except that an anionic type antistatic agent (trade name: Dusper 802D, mfd. by Miyoshi Yushi K. K.) was used as the antistatic agent instead of Efucol 70 used in the antistatic agent solution used in the preparation of Sample 1.

Sample 13

A thermal transfer image receiving sheet (Sample 13) according to the present invention was prepared in the same manner as in the preparation of Sample 1 except that in the formation of the dye receptor layer, the coating based on the application due to a bar coater was simply dried by means of a drier immediately after the application thereof.

With respect to the respective thermal transfer image receiving sheets of Samples 1 to 12 as prepared above, it was found that about 50 wt. % of the antistatic agent was contained in a region corresponding to 1/5 of the thickness of the dye receptor layer on the surface side thereof (i.e., on the side thereof on which the antistatic agent layer was formed). On the other hand, with respect to the thermal transfer image receiving sheet of Samples 13 as prepared above, it was found that about 30 wt. % of the antistatic agent was contained in a region corresponding to 1/5 of the thickness of the dye receptor layer on the surface side thereof.

Comparative Sample 1

A thermal transfer image receiving sheet (Comparative Example 1) was prepared in the same manner as in the preparation of Sample 1 except that the antistatic agent was not added to the receptor layer and the slip layer.

Comparative Sample 2

A thermal transfer image receiving sheet (Comparative Example 2) was prepared in the same manner as in the preparation of Sample 1 except that the antistatic agent was not added to any of the layers constituting the image receiving sheet.

Thermal transfer test

Each of the thermal transfer image receiving sheet as prepared above and thermal transfer sheets of three colors, were loaded in a printer (trade name: S-340, mfd. by Mitsubishi Denki K. K.) and images were printed in a sequence of yellow, magenta and cyan under an environment of 5° C. and 20% RH, thereby to form a full-color image. The image quality of each of the resultant full-color images was evaluated. In the printing operation, the voltage due to charging of the image receiving sheet was measured at the time of (A) the start of the printing operation, (B) after the yellow printing, (C) after the magenta printing, and (D) after the cyan printing. The results are shown in the following Table 1. The voltage due to the charging of the image receiving sheet was measured by means of a surface voltage measuring device (trade name: Statiron SB, mfd. by Shishido Denki K. K.).

TABLE 1

| Thermal transfer image receiving sheet | Voltage due to charging A | B | C | D | Image quality |
|---|---|---|---|---|---|
| Sample 1 | 0 | 0.7 | 1.0 | 1.0 | Good |
| Sample 2 | 0 | 0.7 | 1.5 | 1.5 | Good |
| Sample 3 | 0 | 0.8 | 1.0 | 1.1 | Good |
| Sample 4 | 0 | 0.5 | 0.5 | 0.5 | Good |
| Sample 5 | 0 | 0.6 | 0.8 | 0.8 | Good |
| Sample 6 | 0 | 0.5 | 0.5 | 0.6 | Good |
| Sample 7 | 0 | 0.7 | 1.0 | 1.2 | Good |
| Sample 8 | 0 | 0.1 | 0.1 | 0.1 | Good |
| Sample 9 | 0 | 0.1 | 0.1 | 0.1 | Good |
| Sample 10 | 0 | 3.0 | 4.0 | 5.0 | *1 |
| Sample 11 | 0 | 1.5 | 2.5 | 5.0 | Good |
| Sample 12 | 0 | 3.0 | 5.0 | 8.5 | *2 |
| Sample 13 | 0 | 3.5 | 6.0 | 9.0 | *2 |
| Comparative Sample 1 | 0 | 10 | 20 | 23 | *3 |
| Comparative Sample 2 | 0.5 | 25 | 25 | 27 | *3 |

*1: Image quality was good, but the wear of the head was somewhat increased.
*2: Somewhat good (color dropout was somewhat observed.)
*3: Not good (color dropout was observed.)

The present invention may be practiced in another embodiment, e.g., an embodiment wherein the present invention is practiced in the form of a thermal transfer sheet, etc., to be used in combination with a thermal transfer sheet of a melt transfer type, without deviating from the spirit or major feature thereof. Accordingly, the Examples as described above are simple "examples" in every respect and the present invention should not be interpreted in a restricted manner. The scope of the present invention is defined by Claims and is not confined by the body of the specification at all. In addition, all of the modifications or changes within an equivalent range for claims fall into the scope of the present invention.

What is claimed is:

1. A thermal transfer image receiving sheet comprising a substrate sheet, a dye receptor layer disposed on at least one surface side of the substrate sheet, and an antistatic agent layer disposed on the surface of the dye receptor layer;

wherein the dye receptor layer comprises a dyeable resin and a solvent-soluble antistatic agent.

2. A thermal transfer image receiving sheet according to claim 1, wherein the solvent-soluble antistatic agent is contained in the dye receptor layer in an amount of 0.1 to 10 wt.parts with respect to 100 wt.parts of a resin constituting the dye receptor layer.

3. A thermal transfer image receiving sheet according to claim 1, wherein 50% or more of the solvent-soluble antistatic agent is contained in a region of the dye receptor layer corresponding to 1/5 of the thickness thereof on the surface side of the dye receptor layer.

4. A thermal transfer image receiving sheet according to claim 1, wherein the dye receptor layer has a thickness in the range of 1 to 50 μm.

5. A thermal transfer image receiving sheet according to claim 1, wherein the antistatic agent is contained in the antistatic agent layer in an amount of 0.01 to 1.0 $g/m^2$.

6. A thermal transfer image receiving sheet according to claim 1, wherein the antistatic agent is contained in the antistatic agent layer in an amount which is 1 to 10 times that of the antistatic agent contained in the dye receptor layer.

7. A thermal transfer image receiving sheet according to claim 1, wherein both of the antistatic agents contained in the dye receptor layer and the antistatic agent layer comprise cationic type antistatic agents.

8. A thermal transfer image receiving sheet according to claim 7, wherein the cationic type antistatic agent comprises a quaternary ammonium salt type antistatic agent.

9. A thermal transfer image receiving sheet according to claim 1, wherein the dye receptor layer is disposed on one surface side of the substrate sheet and an antistatic agent layer is disposed on the other surface side of the substrate sheet.

10. A thermal transfer image receiving sheet according to claim 9, wherein the antistatic agent is contained in the antistatic agent layer in an amount of 0.01 to 1.0 $g/m^2$.

11. A thermal transfer image receiving sheet according to claim 9, wherein the antistatic agent is contained in the antistatic agent layer in an amount which is 1 to 10 times that of the antistatic agent contained in the dye receptor layer.

12. A thermal transfer image receiving sheet according to claim 1, wherein the dye receptor layer is disposed on one surface side of the substrate sheet and a primer layer and a slip layer are disposed on the other surface side of the substrate sheet.

13. A thermal transfer image receiving sheet according to claim 12, wherein at least one of the primer layer and the slip layer contains an antistatic agent.

14. A thermal transfer image receiving sheet according to claim 12, wherein an antistatic agent layer is disposed on the slip layer.

* * * * *